United States Patent [19]

Wu

[11] Patent Number: 4,605,045

[45] Date of Patent: Aug. 12, 1986

[54] GRIPPING APPARATUS FOR SHUTTLELESS LOOMS

[76] Inventor: Lien-Shin Wu, No. 151, Section 1, Chang-Mei Road, Chang-hua City, Taiwan

[21] Appl. No.: 774,088

[22] Filed: Sep. 9, 1985

[51] Int. Cl.[4] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 3,638,686 | 2/1972 | Sole et al. | 139/448 |
| 3,915,201 | 10/1975 | Mackie | 139/448 |
| 3,931,837 | 1/1976 | Volpe | 139/448 |
| 4,417,606 | 11/1983 | Corain | 139/448 |

*Primary Examiner*—Henry S. Jaudon

*Attorney, Agent, or Firm*—Charles E. Pfund

[57] ABSTRACT

A novel gripping apparatus for shuttleless looms comprising in combination a weft supplying fork mechanism and a weft transfer hook mechanism. The weft supplying fork mechanism includes a hollow body fixed on a steel belt of a shuttleless loom for movement, a warp-crossing guide member and a weft guide member provided on the body with a weft guide slot therein, as well as a movable grip member disposed on one side of the body for weft gripping operation. The weft transfer hook mechanism comprises a body having an inverse hook at the front and fixed on another steel belt, a movable grip device installed in the body, a yarn-pressing elastic member and a second warp-crossing guide plate fixed on one side, and a second weft guide member provided on top of the body, so that the weft transfer hook mechanism can be completely inserted into the hollow body of the weft supplying mechanism for weft exchanging and transferring operations.

6 Claims, 15 Drawing Figures

GRIPPING APPARATUS FOR SHUTTLELESS LOOMS

BACKGROUND OF THE INVENTION

This invention relates to a novel gripping apparatus, particularly to that type of a steel-belt gripping apparatus which holds the weft to repeatedly traverse the upper and the lower layers of the warp without incurring any collision against the warp.

Shuttleless looms are usually classified into two types—a jet type and a weft-supplying type. The former is operated with water or air ejection to transfer the weft across the warp, while the latter is provided with a weft gripping device to perform the same function. Traditionally, the weft gripping device used in the latter type of looms includes a weft supplying a fork and a weft transfer hook. As shown in FIG. 1A, with the weft held in position, the weft supplying fork delivers the weft from an open side to a midway point wherefrom the weft is picked up by the weft transfer hook and carried to the other side. The drawbacks of the conventional gripping device are: (1) both the fork and the hook are bulky and heavy, easy to collide with or break the warp; (2) greater driving power is necessary; (3) if the speed of the gripping device is fast, it is easy to break the weft; and (4) the loom adapted to the conventional gripping device is also bulky, and greater installation space is required.

Shown in FIG. 1B is an improved gripping device in which the fork and the hook have been both reduced in size, and in which the fixed weft supplying and transfer mast is replaced with a relatively movable steel belt, main changes in minimizing the physical volume of the entire loom. However, the gripping device is still bulky and the operational speed cannot be fast. Moreover, as the weft supplying action is synchronized with internal weft gripping operation through a pair of parallel installed plates within two bottom sides of the gripping device, the gripping effect is not satisfactory and results in producing longer residual yarn from the weft tailings (the width of the residual yarn is about 40–60 mm). Besides, the operational speed is still slow, and greater power is still required. The main reason for this defect is that the size of the gripping device is too large. Referring to FIGS. 1, 1A, 1B and 1C represent different sizes of the gripping device, and the reference letters denote respectively: u the upper warp layer, d the lower warp layer, h the heald frame, and r the reed. The movement of the gripping device generally follows the back-and-forth motion of the reed's swing while the movement of the upper and lower warp layers is to swing up and down alternatively under the driving force of the heald frame. The gripping device holding the weft travels through the opening of the upper and lower warp layers u and d at each of therir intersections. However, if the size of the gripping device is as large as that shown in FIG. 1A, it must wait until the opening of the upper and lower warp layer is at its maximum so as to effect quick passing with the weft through the opening (as shown in FIG. 1A'). In addition, as the duration of the passing action of the gripping device is very short, the moving speed thereof must be increased. Consequently, owing to the higher tensile force applied by the gripping device, the weft is easily broken. Preferably, if the size of the gripping device is as small as that shown in FIG. 1C, the gripping device can quickly cross the upper and the lower warp layers u and d upon the initial intersection opening (as shown in FIG. 1C') at the time duration of c—c'. Therefore, the gripping device has sufficient time to travel through the two warp layers, and the weaving speed is substantially increased. Above all, weft breaking is greatly minimized. Owing to the small size of the gripping device, it seldom collides with the warp layers, and, therefore, no warp will be caused to break. According to the knowledge of the inventor, the size of the gripping device currently used in the European countries is about the same size as that shown in FIG. 1A, while the size of the gripping device presently in use in the States and in Japan as well as in Taiwan is about the same size as that shown in FIG. 1B. The operating speed of the known gripping device is limited accordingly.

The facts are numerous concerning the bulky size of the conven-tional gripping device. Except for the fact that a technical breakthrough remains to be made, the most important one is that the gripping elements of the weft supplying fork in the conventional gripping device are usually disposed in the inner portion of the device. In other words, the weft supplying fork must have a weft gripping element for delivering the weft to the hook member, and the weft gripping element must also be a movable part; therefore, if the gripping element is installed in the weft supplying fork, the physical volume of the weft supplying fork will certainly be maximized. Also a weft gripping element internally installed in the weft supplying fork suffers some problems: (1) since the gripping element is arranged within the inner portion of the weft supplying fork, the weft exchange actions of both the weft supplying fork and the weft transfer hook must be synchronized perfectly, otherwise, no exchange action will take place; (2) during the exchange action conducted by the weft transfer hook within the weft supplying fork, the gripping element is easily bumped and damaged; and (3) it is difficult to repair the damaged gripping element.

SUMMARY OF THE INVENTION

It is accordingly a primary object of this invention to provide a new gripping apparatus for shuttleless looms with a structure of small size and light weight to obtain advantages of incurring no collision with the warp, minimizing warp breaking, reducing the driving power, and increasing the weaving speed.

It is another object of this invention to provide a new gripping apparatus for shuttleless looms by arranging the gripping element on the outer side of the weft supplying fork so that the body of the weft supplying fork is hollow, and no collision with the weft transfer hook will be made during weft exchange operation. Thus, the damage rate of the gripping element is minimized, and the life expectancy of the gripping apparatus is extended accordingly.

It is a further object of this invention to provide a new gripping apparatus for shuttleless looms with a simplified weft transfer hook mechanism for convenient assembly, disassembly, and maintenance.

It is still another object of this invention to provide a new gripping apparatus for shuttleless looms, which allows the gripping member to have sufficient time to carry the weft across the upper and the lower warp layers without causing the weft to break.

It is yet a further object of this invention to provide a new gripping apparatus for shuttleless looms whereby, the gripping action of both the weft supplying fork mechanism and the weft transfer hook mechanism is accurate and also adjustable for precisely controlling the weft length and reducing the residual yarn at the cloth edge, so as to save material and minimize manufacturing cost.

In the present invention, these and other objects are achieved by providing a novel gripping apparatus for shuttleless looms, which gripping apparatus comprises in combination a weft supplying fork mechanism and a weft transfer hook mechanism. The weft supplying fork mechanism includes: a hollow body structure in a general square tubular form whose bottom portion can be fixed on a steel belt for sliding on a prearranged track; a first warp-crossing guide plate shaped like a knife-tip at the front, provided at one side of the body with an extended rear portion defining a weft guide slot therein; a set of gripping members installed on the other side of the body for holding the tail end of the weft; a first weft guide plate disposed on top of the body and extending to the warp guide plate of the other side to enable the tail end of the weft to be held by the gripping member and to allow the other end (moving end) of the weft to slide into the weft guide slot and pass through it for being transversely laid in the hollow body of the weft supplying fork.

The weft transfer hook mechanism includes: a hook body whose rear bottom can also be fixed on the steel belt; an inverse hook gripping member provided at the front of the body; a second weft guid plate disposed on the top, defining a weft guide slot with the body; and a second warp-crossing guide plate disposed on one side of the body which can be completely inserted into the hollow body of the weft supplying fork mechanism.

With the combination of the aforesaid elements, when the weft transfer hook mechanism is inserted into the hollow body of the weft supplying fork mechanism, the inverse hook member will overpass the weft transversely laid therein, causing the weft to slide into the weft guide slot of the weft transfer hook mechanism, so that when being moved out of the weft supplying fork mechanism in the reverse direction, the weft is gripped through the inverse hook member, and the tail end of the weft is left off the gripping member of the weft supplying fork mechanism. In this way the weft is transferred from one side to another side of the warp.

These objects and advantages of the invention will become clear from the following description of a preferred embodiment when read in conjunction with the accompanying drawings.

DETAILED DESCRIPTION OF THE PREFERRED EMBODIMENT

Figure 2:
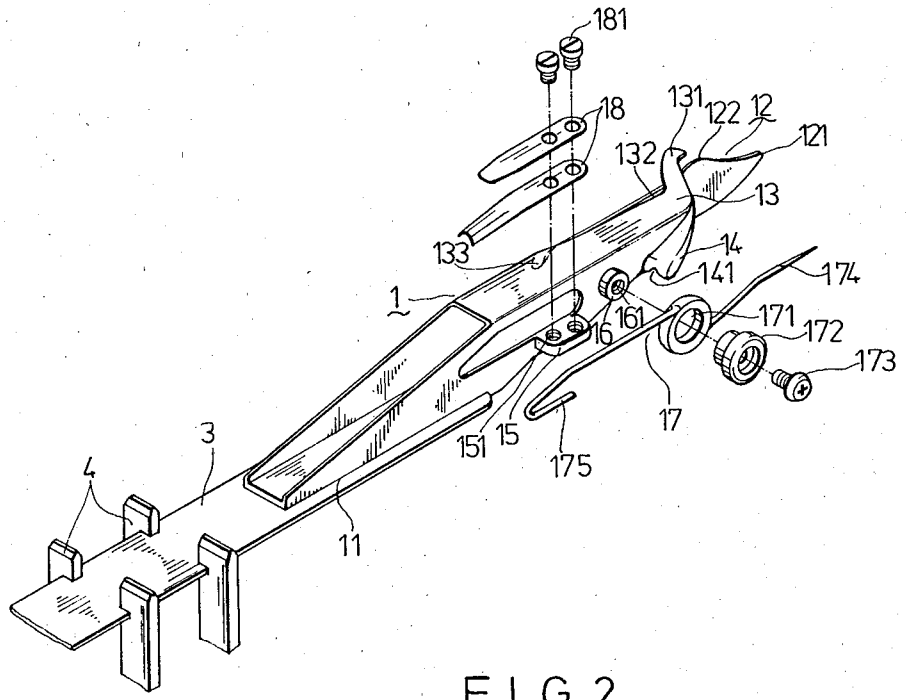
FIG. 2 is a perspective and exploded view of a preferred embodiment of a weft supplying fork mechanism according to this invention.
Figure 3:
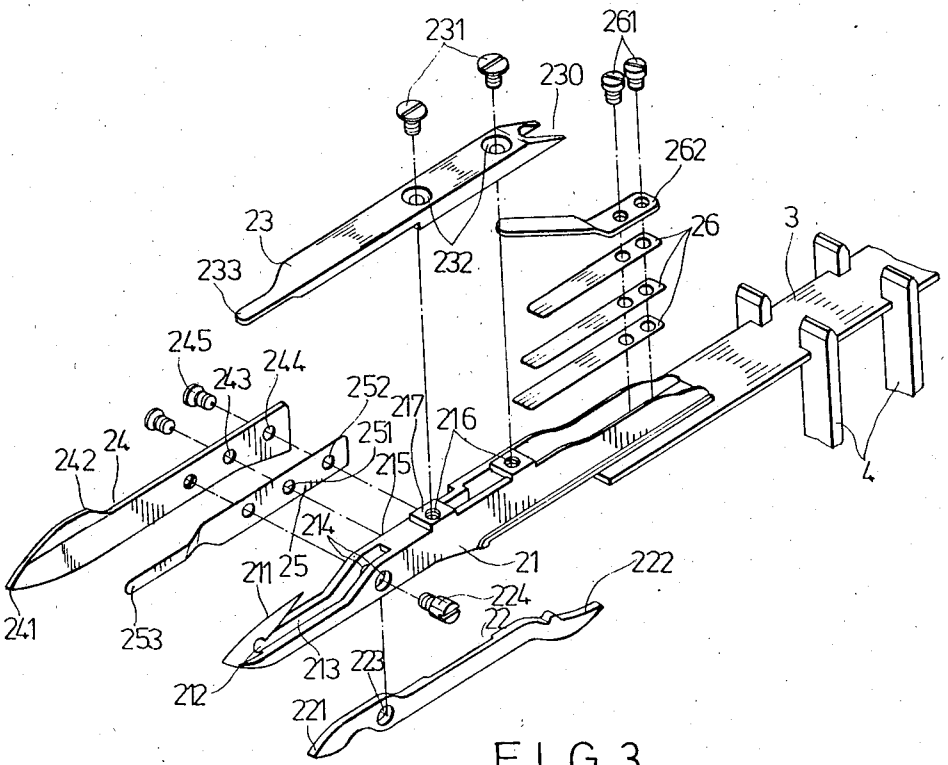
FIG. 3 is a perspective and exploded view of a preferred embodiment of a weft transfer hook mechanism according to this invention.
Figure 4:
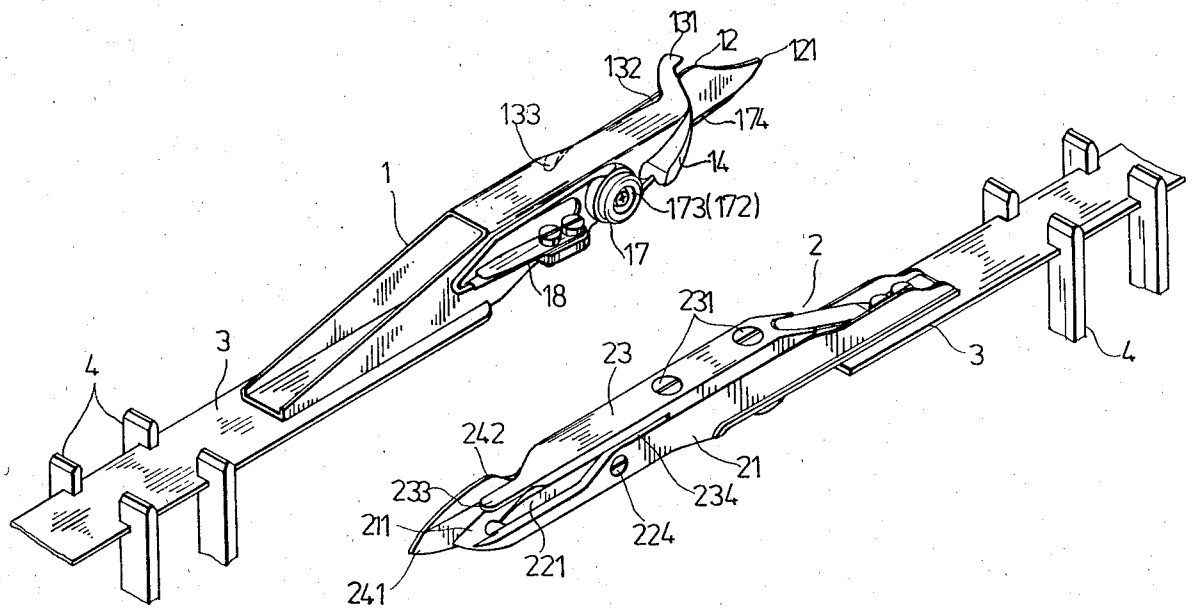
FIG. 4 is a perspective view of the assembled preferred embodiments shown in FIGS. 2 and 3.

Referring to FIGS. 2, 3 and 4, a preferred embodiment of a new gripping apparatus for shuttleless looms according to this invention comprises in combination a weft supplying fork mechanism 1 and a weft transfer hook mechanism 2.

Figure 5:
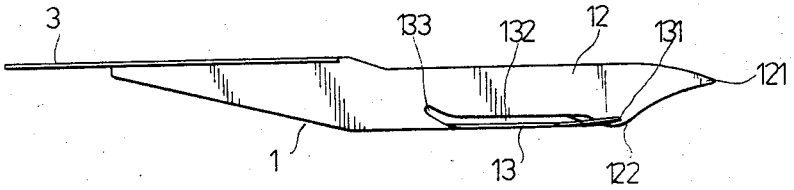
FIG. 5 is a rear view of the preferred embodiment of the weft supplying fork mechanism.
Figure 6:
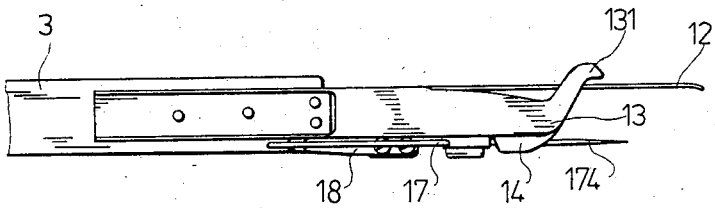
FIG. 6 is a top view of the preferred embodiment of the weft supplying fork mechanism.

As shown in FIG. 2, the preferred embodiment of the weft supplying fork mechanism 1 has a hollow body structure in a general square tubular form whose bottom portion 11 can be fixed on a steel belt 3 which, under a driving element can slide in a post-like track 4. (Since the driving element and the post-like track form no part of this invention, description is omitted). A first warp-crossing guide plate 12 similar to a knife shape at the front with a pointed front end 121 and a protrusion 122 is disposed at the left side of the body (please also refer to FIGS. 5, 6 and 7). Provided on top of the body is a first weft guide plate 13 whose front end 131 extends toward the left outside of the body and slightly inclines downward at the place close to the protrusion 122 of the first warp-crossing guide plate 12 in order that when crossing the warp, it enables the warp to pass over the top of the first weft guide plate 13 along the protrusion 122 of the frist warp-crossing guide plate 12 for convenient travel through the warp. The left side of the first weft guide plate 13 and the first warp-crossing guide plate 12 define a weft guide slot 132 and a bottom portion 133. An oblong flange 14 having a curved slot 141 at the lower part is provided at the front right side of the body, and a lug 15 with a pair of screw holes 151 is located at the rear portion. At the middle part of the body of the weft supplying fork mechanism 1 there is an annular protuberance 16 with a screw hole 161 in the center. A movable grip arm 17 having a central through hole 171, a curved portion 174 at one end and hook part 175 at another end is movably screw-connected to the right side of the body through a gasket ring 172 and a screw 173 such that the grip arm 17 can swing up and down along the annular protuberance 16. In addition, the cylindrical portion 174 matched with the curved slot 141 of the oblong flange 14 forms a weft gripping member. The close gripping action of this gripping member holds the weft effectively. Moreover, the forward extending part of the curved portion 174 can also serve to guide the weft to enter into the gripping member. A plurality of elastic plates 18 each having screw holes in their front portion are connected one on top of another to the lug 15 with their rear free ends abutting on the hook portion 175 of the movable arm 17 so that a gripping force is applied thereto through the elastic plates 18. As can be seen in FIG. 4, the oblong flange 14, the movable arm 17 and the elastic plates 18 form a weft gripping arrangement whose gripping force can be adjusted by properly determining the quantity of the elastic plates 18.

The weft transfer hook mechanism 2, as shown in FIG. 3, is generally combined by a body 21, a movable grip rod 22, a second weft guide plate 32, a second warp-crossing guide plate 24, a yarn-pressing spring member 25 and a plurality of elastic plates 26.

Figure 8:
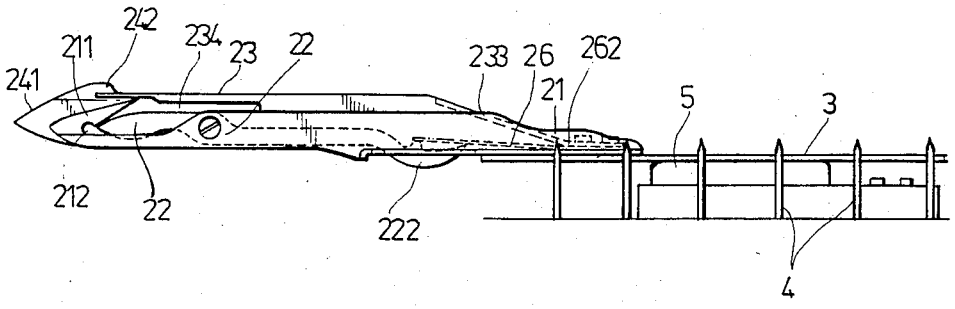
FIG. 8 is a side view of the preferred embodiment of the weft transfer hook mechanism.

The rear bottom portion of the body 21 can also be fixed on another steel belt 3 to be moved along therewith; the front portion is formed in a tapered edge and has an inverse hook 211 with an arch part 212 located at the inclined bottom portion thereof. A through slot 213 is longitudinally provided in the body 21 with a through hole 214 and a screw hole 215 respectively provided in the side portion. The movable grip rod, 22 having an inclined portion 221 at the front, a through hole 223 in the middle and a recess part 222 at the rear, is movably secured in the body 21 by a screw bolt 224 in the through hole 214 and 223 such that the movable grip rod 22 can swing up and down in the through slot 213, and a gripping part is defined by the inclined portion 221 and the inverse hook 211 (please refer to FIG. 8) thereat. Moreover, the defined gripping part, as can be seen from the side view of FIG. 8, is formed in a generally conical slit so that the tightness of the gripping action may be increased. In the rear portion of the through slot 213, the elastic plates 26, together with an arch spring member 262, are connected one on top of another to the bottom surface of the through slot 213 by a pair of screws 261 with the head portion of the elastic plates 26 pressing against the rear end of the movable grip rod 22 in applying a gripping force thereto. In addition, with the pressure provided by the elastic plates 26, the bottom side of the recess 222 of the movable grip rod 22 is pressed to protrude below the bottom surface level of the steel belt 3 (as shown in FIG. 8), so that when the belt 3 is retracted to pass over a weft-releasing protuberance 5 provided within the track 4, the protuberance 5 will push upward the bottom surface of the recess portion 222 of the movable grip rod 22, thereupon causing the gripping part formed by the inclined portion 221 of the movable grip rod 22 and the inverse hook 211 to open and release the weft. The second weft guide plate 23, having an inclined fork rear end 230, a sloping front end 233 and a plurality of screw holes 232 formed in the top, is fixed on a support stand 217 on top of the body 21 by screws 231 through screw holes 232 and 216 located in the support stand 217. At the connection of the second weft guide plate 23 to the body 21, a weft guide slot 324 is formed therebetween. In addition, the free end of the arch spring member 262 is kept in close contact with the top surface of the body 21 and the inclined fork end 230 of the second weft guide plate 23. The top surface of the arch portion of the spring member 262 extends slightly over the area of the body 21 it contacts, so as to smoothly cross the warp.

Figure 9:
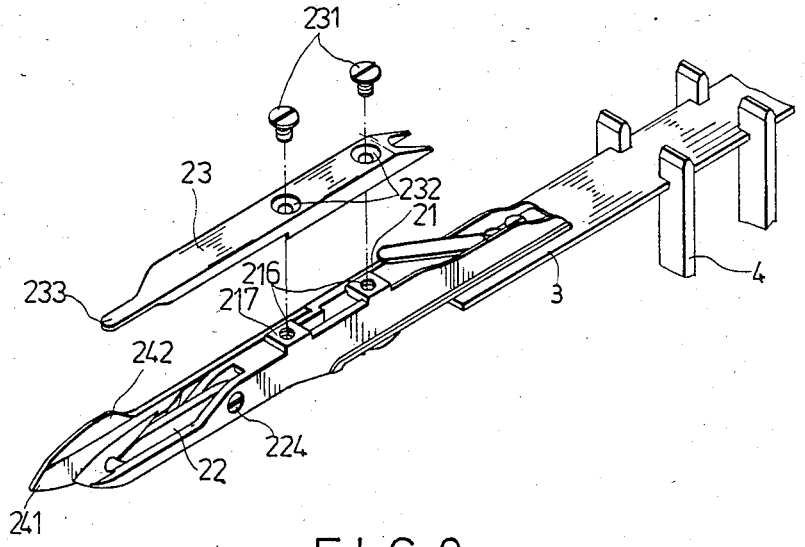
FIG. 9 is a perspective view of a partially assembled preferred embodiment of the weft transfer hook mechanism.

Referring to FIG. 3 again, the yarn-pressing spring member 25 includes a narrow front portion 253, which is slightly bent inward, and a pair of screw holes 251 and 252 located in the wider rear part. The second warp-crossing guide plate 24 has an inclined tip portion 241 with a projected part 242 at the front, a screw hole 243 in the middle and a through hole 244 in the rear. The yarn-pressing spring member 25 together with the second weft guide plate 24 are connected on one side of the body 21 (as shown in FIG. 9) by the screw bolt 224 in the screw hole 243 and a screw 245 in the through hole 244 and the screw hole 215, so that, the inwardly bent front portion 253 of the yarn-pressing spring member 25 is closely pressed against the side of the inverse hook 211 forming a gripping part thereat.

Figure 7:
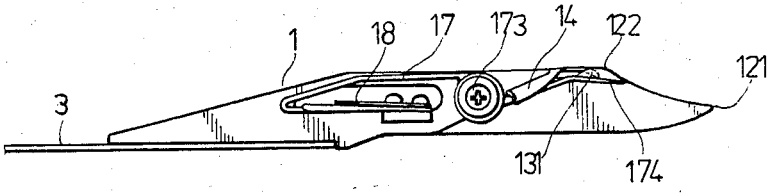
FIG. 7 is an elavation view of the preferred embodiment of the weft supplying fork mechanism.
Figure 10A:
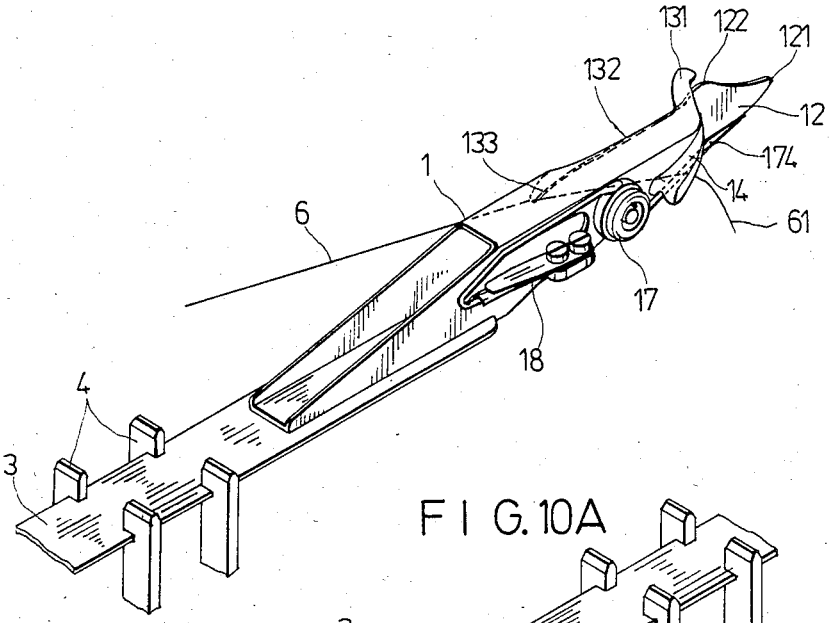
FIGS. 10 (A, B, C) is an operational illustration of the gripping apparatus in combination with the preferred embodiment of the weft supplying fork mechanism and the weft transfer hook mechanism according to this invention.
Figure 10B:
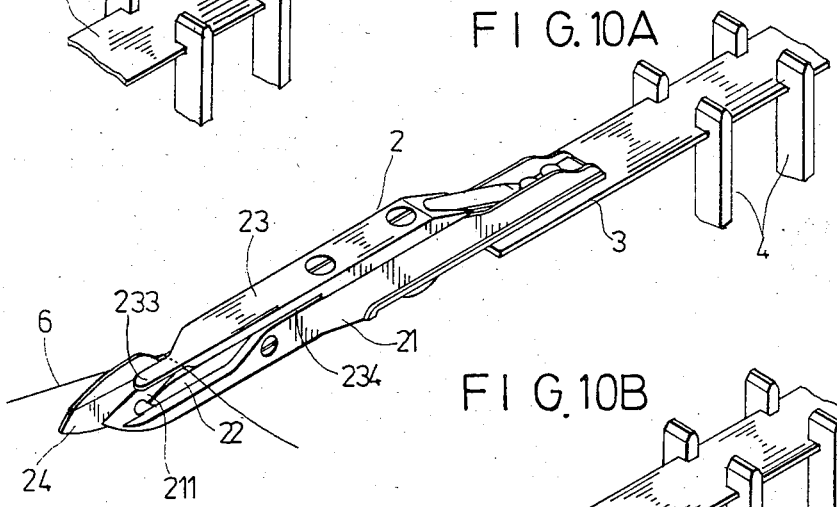
Figure 10C:
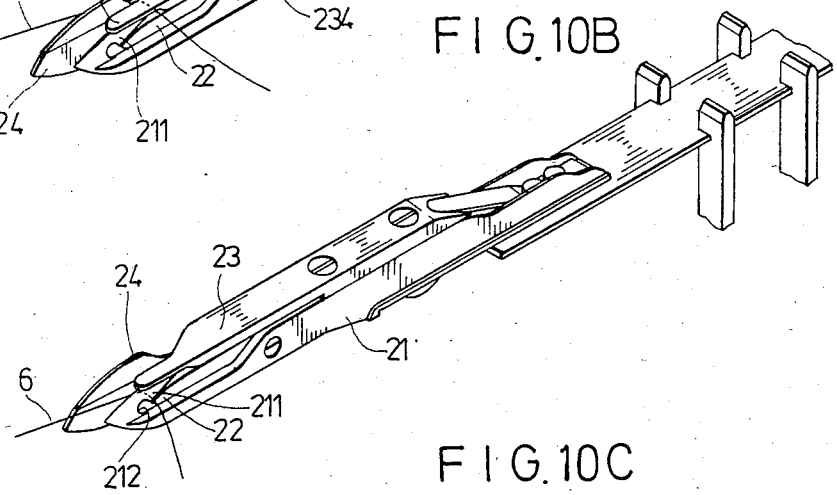

Referring to FIG. 10, the steps of the gripping operations performed by the preferred embodiments for holding the weft and transferring it from one side of the warp and to the other side according to this invention are as follows:

(1) When the front end 121 of the first warp-crossing guide plate 12 of the weft supplying fork mechanism 1 passes through the weft 6, the weft 6 will slide on the area adjacent to the protrusion 122, and, as the weft level is lower at its left side, it will be hooked by the front end 131 of the first weft guide plate 13 and guided to the bottom portion 133 thereof along the weft guide slot 132 (please refer to FIG. 7). At this time, the tail end of the weft 6 will continue to slide down to the gripping portion formed by the oblong flange 14 and the cylindrical portion 174 of the movable grip arm 17, it will be gripped thereat to be laid in a transverse direction within the hollow body of the weft supplying fork mechanism 1.

(2) When the weft supplying fork mechanism 1 travels midway between the upper and the lower warp layers, the weft transfer hook mechanism 2, which is also moved into the midway of the warp, will be inserted into the central portion of the hollow body of the weft supplying fork mechanism 1 for the exchange of the weft 6.

(3) As the weft transfer hook mechanism 2 is moved in contact with the weft 6, the weft 6 will first slide along the surface of the inverse hook 211, and then move upward toward the second warp-crossing guide plate 24; the weft transfer hook mechanism 2 continues to move forward to the front end 233 of the second weft guide plate 23, at which point, the weft 6 will be guided into the weft guide slot 234 defined by the lower portion of the second weft guide plate 23 and the body 21.

(4) When the weft transfer hook mechanism 2 reaches the limit of its movement and starts to move in a reverse direction, the weft 6 will be hooked by the inverse hook 211 and held in the gripping portion thereat. (The weft supplying fork mechanism 1 will have also started to move backward upon the weft being picked up by the weft transfer hook mechanism 2.)

(5) When the weft transfer hook mechanism 2 continues to move backward, it will cause the tail end of the weft 6 to come off from the gripping member of the weft supplying fork mechanism 1 (as it is held by the gripping member of the weft transfer hook mechanism 2) and to be pulled to the other side of the warp.

(6) When the weft transfer hook mechanism 2 is moved back to its predetermined position, the weft releasing protuberance 5 within the track 4 will impel the bottom surface of the recess portion 222 of the movable grip rod 22 (as shown in FIG. 8) to move upward to release the weft 6 gripped in the gripping portion of the inverse hook 211 (by this time the weft supplying fork mechanism 1 will have also moved back to its predetermined position).

(7) When the weft 6 is released, it will slide downward into the arch part 212 of the inverse hook 211 and will be pressed by the yarn-pressing spring member 25 so as to prevent the weft 6 from bouncing back therefrom. Thus, one complete transfer of the weft 6 is accomplished.

Figures 1A, 1B, 1C:
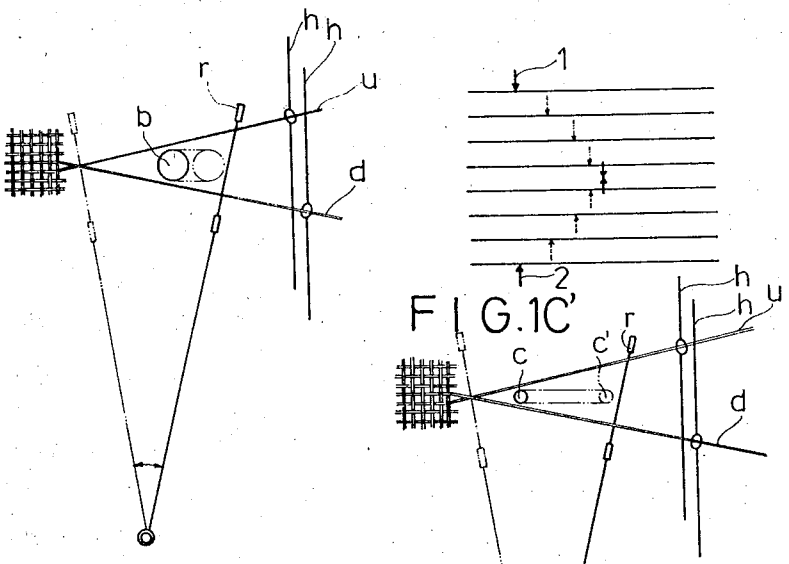
FIG.1A' PRIOR ART
FIG.1A PRIOR ART
FIG.1B PRIOR ART
FIG. 1 is a schematic illustration of different sizes of a gripping device for shuttleless looms wherein the sizes shown in FIGS. 1A, 1B and 1A' are the known gripping device while that shown in FIGS. 1C and 1C', is the desired size of a new gripping device.

It shall be appreciated that, since the gripping elements of the weft supplying fork mechanism 1 are installed on the outer side of the bod, the physical volume of the entire loom can be considerably reduced. The advantages enduring from the small size of this invention are as follows: (1) The small driving power required reduces power consumption. (2) Lack of collision with the warp minimizes the warp-breaking rate; (3) Warp-crossing time is sufficient. As shown in FIG. 1C', even when the opening angle of the warp is not yet at its widest condition, the weft supplying fork mechanism 1 and the weft transfer hook mechanism 2 have already moved toward the middle of the warp; at the maximum opening of the warp, the weft transfer hook mechanism 2 is inserted into the weft supplying fork mechanism 1, accomplishing the weft exchange action, and is retracked in the inverse direction before the closing of the warp. (4) Since sufficient time is available for weft exchange operation, the weft-breaking rate is reduced, particularly beneficial in view of the weak yarn of the weft. (5) The weaving speed can be increased. (6) The gripping action of the preferred embodiments is accurate, and the width of the residual yarn at the cloth edge is minimized, saving material and reducing costs. (7) the gripping force can be optionally adjusted by the arrangement of the eleastic plates so as to be adapted to various kinds of weft. (8) The physical volume of the loom is reduced and its entire structure is simplified, reducing trouble and making maintenance easier.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, fall within the scope of the invention aa claimed.

What is claimed is:

1. A gripping apparatus for shuttleless looms having a set of steel belts arranged in a opposite position to be driven to slide in a post-like track by a driving power thereof, and a protuberance provided between the track, comprising in combination:

a weft supplying fork means having a hollow body structure with its bottom portion fixed on one of the steel belts for carrying a weft, which is laid in a traverse position in the hollow body structure, from one side of a warp arrangement in a shuttleless loom, and moving along with the steel belt to a predetermined position; and a weft transfer hook means having a body with its rear bottom portion fixed on another steel belt of the shuttleless loom and its front portion formed in a tapered edge for weft gripping operation, a through longitudinal slot formed in the body with a through hole and a screw hole respectively provided in opposite sides defining the through slot, a support stand with a plurality of screw holes formed therein provided on top of the through slot so as to form a weft guide and gripping arrangement in the body, suitable for being entirely inserted in the hollow body structure of said weft supplying fork means;

whereby, when both said weft supplying fork means and said weft transfer hook means move toward each other in an opening of the warp from opposite sides thereof along with the steel belts for weft exchanging operation, said weft transfer hook means will be completely inserted into the hollow body of said weft supplying fork means at a predetermined position in the opening of the warp, and will grip the weft traversely laid in said weft supplying fork means and transfer the weft back to the side of the warp without incurring any breaking of either the warp or the weft.

2. A gripping apparatus for shuttleless looms according to claim 1 wherein said weft supplying fork means comprises:

a first warp-crossing member similar to a knife shape provided at one side of the body structure with its knife-shaped portion extending over a rear portion of the body structure;

a first weft guide member formed on top of the body structure with its inclined end meeting a protrusion of the knife-shaped portion of said first warp-crossing member, defining therebetween a weft guide slot; and a weft gripping means provided at a right side of the body, so that one tail end of the weft can be held by said weft gripping means while another end (moving end) of the weft will be guided into said weft guide slot along the knife-shaped portion of said first warp-crossing guide member and the inclined part of said first weft guide member so as to lay the weft in a traverse direction within the hollow body.

3. A gripping apparatus for shuttleless looms according to claim 2 wherein said weft gripping means comprises:

an oblong flange with a curved slot on its underside provided on a front side of the body, a lug with a plurality of screw holes located on a rear portion of the body;

an annular protuberance with a central screw hole located on a middle portion of the body;

a movable grip arm having an inward hook part at one end, a through hole in its middle and a curved portion at another end movably connected to a right side of the body by a gasket ring and a screw on said annular protuberance through the central screw hole with the curved part abutting the curved slot of said oblong flange; and a plurality of elastic members each having a plurality of screw holes at one end connected one on top of the next to said lug through the screw holes of both the elastic members and the lug with stacked free ends abutting a top surface of the inward hook part of said movable grip arm so that a gripping force is applied to the curved part against the curved slot of the oblong flange for the purpose of gripping the weft.

4. A gripping apparatus for shuttleless looms according to claim 1 wherein said weft transfer hook means comprises:

a body hvaing a through longitudinal slot with an inclined inverse hook part located at its front end;

a movable grip rod having an inclined portion at the front, a through hole in the middle and a recess part at the rear movably secured in the through longitudinal slot with the inclined portion in contact with inverse hook part of the body for being moved open and close therewith;

a plurality of elastic members, having a top one formed in an arch shape at one end, connected one on top of another in a rear portion of the through longitudinal slot with all their head portions of the elastic members except that of the arch-shaped elastic member pressing against the recess part of said movable grip rod so as to cause a lower portion of the recess part to extend over the bottom level of the body as well to enable the inclined part of said movable grip rod to be in close contact with the inverse hook part of the body, said arch-shaped elastic member having its unconnected end kept firmly arched by top of the body with its higher arched portion extending thereat for facilitating warp crossing action;

a yarn-pressing elastic member having a narrow front portion which is slightly bent inwardly thereat connected to one side of the body with the narrow front part pressing agaisnt one side of the inverse hook part of the body;

a second warp-crossing guide member having an inclined tip portion with a projected part at the front connected to the side of the body on top of the yarn-pressing elastic member with the inclined tip adjacent to the inverse hook; and a second weft guide member having a tapered portion at the front and a sloping fork end at the rear secured on top of the body with its front tapered end extending over the inverse hook and defining a weft guide slot with the second warp-crossing guide member thereat, and its sloping fork end kept in close contact with the front end of the arch-shaped elastic member, so that, when said weft transfer hook means is completely inserted into the hollow body of said weft supplying fork means, the weft laid in a traverse position within the hollow body portion of said weft supplying fork means will slide into the weft guide slot defined by said second weft guide member and said warp-crossing guide member, and will be gripped by a gripping part formed by the inverse hook and the inclined portion of said movable grip rod so as to be transferred to another side of the warp during the backward movement of said weft transfer hook means.

5. A gripping apparatus for shuttleless looms according to claim 4 wherein said gripping part formed by the inverse hook and the inclined portion of said movable grip rod includes a generally conical slit located at the lower part of the inverse hook so that when the weft held in the gripping part is released thereat, the weft will slide down into the conical slit for further handling.

6. A gripping apparatus for shuttleless looms according to claim 4 wherein said yarn-pressing elastic member is characterized by its inwardly bent front narrow portion kept in close contact with the side of the inverse hook to apply a gripping force therat so that when the weft held by the inverse hook and the inclined portion of the movable grip rod is released thereat, the released weft will be held by the yarn-pressing elastic member to prevent the weft from bouncing therefrom.

* * * * *